US008104540B2

(12) United States Patent
Leitch

(10) Patent No.: US 8,104,540 B2
(45) Date of Patent: Jan. 31, 2012

(54) COMPLETION TOOL

(75) Inventor: Andrew Leitch, Aberdeen (GB)

(73) Assignee: Pump Tools Limited (GB)

( * ) Notice: Subject to any disclaimer, the term of this patent is extended or adjusted under 35 U.S.C. 154(b) by 0 days.

(21) Appl. No.: 12/366,917

(22) Filed: Feb. 6, 2009

(65) Prior Publication Data

US 2009/0200034 A1 Aug. 13, 2009

(30) Foreign Application Priority Data

Feb. 7, 2008 (GB) ..... 0802221.2

(51) Int. Cl.
*E21B 34/08* (2006.01)

(52) U.S. Cl. ..... 166/334.2; 166/105.4; 166/321

(58) Field of Classification Search ..... 166/52, 166/54.1, 105.4, 321, 334.2, 242.3
See application file for complete search history.

(56) References Cited

U.S. PATENT DOCUMENTS

| | | | | | |
|---|---|---|---|---|---|
| 3,332,497 | A | * | 7/1967 | Page, Jr. | 166/329 |
| 3,997,148 | A | * | 12/1976 | Karcher et al. | 266/218 |
| 4,171,019 | A | * | 10/1979 | Cole | 166/341 |
| 4,263,936 | A | * | 4/1981 | Brown | 137/496 |
| 4,456,221 | A | * | 6/1984 | Bryant | 251/152 |
| 4,694,855 | A | | 9/1987 | Cunningham | |
| 5,975,209 | A | * | 11/1999 | McCorry | 166/321 |
| 6,497,278 | B1 | * | 12/2002 | Norris | 166/242.3 |
| 6,508,308 | B1 | | 1/2003 | Shaw | |
| 6,920,930 | B2 | * | 7/2005 | Allamon et al. | 166/318 |
| 7,044,232 | B2 | * | 5/2006 | Jordon et al. | 166/380 |
| 2004/0060707 | A1 | * | 4/2004 | Bearden et al. | 166/380 |

FOREIGN PATENT DOCUMENTS

| | | |
|---|---|---|
| GB | 2288197 | 10/1995 |
| GB | 2 327 961 A | 2/1999 |
| GB | 2391242 | 2/2004 |
| GB | 2395500 | 5/2004 |
| WO | 98/03766 A1 | 1/1998 |
| WO | 02/075111 A1 | 9/2002 |

* cited by examiner

*Primary Examiner* — William P Neuder
*Assistant Examiner* — Elizaeth Gottlieb
(74) *Attorney, Agent, or Firm* — DLA Piper LLP (US)

(57) ABSTRACT

A differential pressure operated blanking tool includes a Y-tool having first and second limbs connected together via a throat. A ball valve is selectively positionable to close one or other limb of the Y-tube against fluid flow. A housing has an opening in one side thereof of a size sufficient to allow the hall to pass through, and an actuator mounted on the second limb and in the housing wherein fluid flow within the tool carries the ball valve through the opening in the housing to a position where the second limb is closed against bias of the actuator. When the fluid flow is removed, the actuator operates to force the ball valve out of engagement with the second limb whereupon the ball passes through the opening in the housing towards the first limb.

12 Claims, 1 Drawing Sheet

COMPLETION TOOL

FIELD OF THE INVENTION

This invention relates to a completion tool and, more particularly to a differential pressure operated blanking tool particularly suitable for use in but not limited to well completion operations. The invention finds particular application in blanking off a by-pass tube of a Y-tool which has an electric submergible pump mounted on the bottom of the other limb.

BACKGROUND

A well known application for Y-tools is the mounting of an electric submersible pump in a well bore or production tubing. The pump is mounted on the lower end of the main limb of the Y-tool and the by-pass limb provides a pathway for access below the pump to well tools and logging tools into the well. By passing such tools through the by-pass limb of the Y-tool, the electric submersible pump does not have to be recovered from the well before such an operation is carried out. Generally, the bypass limb of the Y-tool will descend further into the well bore than the main limb in order to ensure that well tools and logging tools passing through the by-pass limb, exit the by-pass limb beneath the electric submersible pump. These tools can then continue down into the well below the pump.

While the by-pass limb of the Y-tool provides a convenient path through the well beneath the electric submersible pump, while the pump is operating, the by-pass limb is generally closed off to fluid flow thereby forcing fluid flow up the main limb of the Y-tool.

Blanking plugs are known for insertion into the by-pass limb during operation of the electric submersible pump. However, such blanking plugs must be recovered via a wire-lining operation each time access is required through the by-pass limb and therefore automatic pressure operated valves have been used to selectively open and close the by-pass limb of a Y-tool.

A known blanking tool is described in GB 2 327 961 in which a flapper valve is pivotally mounted between the two limbs of the Y-tool and can take up a position wherein one or other limb is closed or, in the absence of fluid flow, a position wherein both limbs are open to allow for access for logging tools to the well via the by-pass limb.

The flapper valve is provided with sealing means on the upper and lower faces. When one of the limbs of the Y-tool is closed off, the flapper valve adopts a position over that limb. Sealing means may also be provided on around the upper edge of the limbs such that closure of the flapper valve over one of the limbs seals that limb against fluid flow.

However, the flapper valves which are used are susceptible to wear and tear over time and the upper and lower surfaces of the flapper valve can become warped which prevents the valve from maintaining an effective seal within the valve seats at the top of each limb of the Y-tool. If the flapper valve is unable to provide an effective seal across either or both of the limbs of the Y-tool, the required pressure differential will not be established across the valve and the valve will effectively take up an open position between the two limbs of the Y-tool at all times.

Replacement of the flapper valve requires recovery of the Y-tool from the well leading to a length and costly shut down operation.

SUMMARY OF THE INVENTION

It is an object of the present invention to provide an improved differential pressure operated blanking tool which is aimed at addressing the problem of wear and tear as described above.

According to one aspect of the present invention there is provided a differential pressure operated blanking tool comprising a Y-tool having first and second limbs connected together via a throat and a ball valve selectively positionable to close one or other limb of the Y-tube against fluid flow.

Preferably the first limb is adapted to mount an electrically operated pump thereon and the second limb is adapted to allow for the access by well tools or logging equipment below said pump.

Alternatively each of the limbs is adapted to mount an electrically operated pump thereon.

Advantageously said tool further comprises an actuator to bias the ball valve out of contact with one of the first or second limbs.

Preferably the actuator is mounted on the second limb, the arrangement being such that fluid flow within the tool can carry the ball valve to a position where the second limb is closed against the bias of the actuator and when said fluid flow is removed, the actuator operates to force the ball valve out of engagement with the second limb.

Preferably the tool further comprises biasing means to operate the actuator when the fluid flow holding the ball valve atop the second limb is removed.

Advantageously, the actuator is mounted in a housing.

Preferably the housing is provided on top of the second limb.

Preferably the biasing means is a spring.

Advantageously the actuator comprises a cradle which supports the ball valve.

Conveniently the cradle comprises a substantially U-shaped body.

Preferably the cradle is substantially horse-shoe shaped.

Preferably also the body is pivotally mounted to the housing.

Preferably the tool further comprises a pathway for transit of the ball valve between the two limbs.

Advantageously the pathway has a substantially circular inner surface.

Conveniently the inner surface of the pathway is of a slightly larger diameter that the ball valve.

When the pump is operating, fluid pressure generated below the ball valve will displace the ball valve from the top of the main limb of the Y-tool. The ball will be carried along a path defined in the Y-tool to a position atop the by-pass limb where it is retained by fluid pressure. When the fluid pressure from the pump drops such as when the pump is switched off, the actuator moves to the biased position and the ball is dislodged from the top of the by-pass limb and returns under gravity to a position on top of the main limb of the Y-tool.

As the ball moves between the top of each limb of the Y-tool it rotates and therefore presents a fresh surface each time it lands in the top of either the main limb or the by-pass limb of the Y-tool. This overcomes the problems associated with degradation of the surface of the flapper valve as discussed in relation to the prior art.

BRIEF DESCRIPTION OF THE DRAWINGS

An embodiment of the present invention will now be described with reference to and as shown in the accompanying drawings.

DETAILED DESCRIPTION

Figure 1:
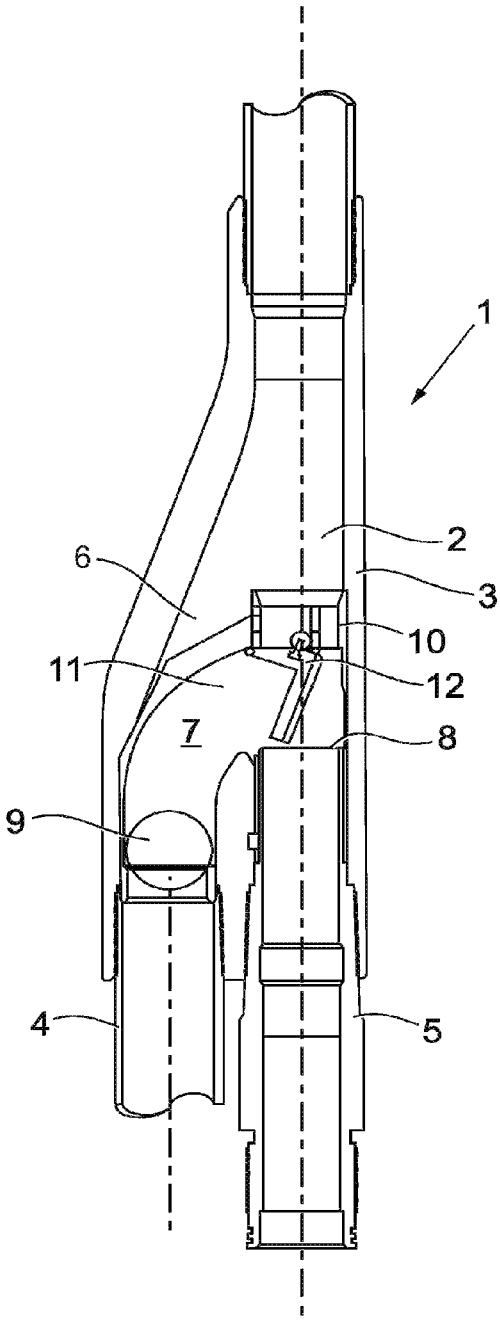
FIG. 1 is a partial cross-sectional view of a completion tool according to one aspect of the present invention in a first operating condition.
Figure 2:
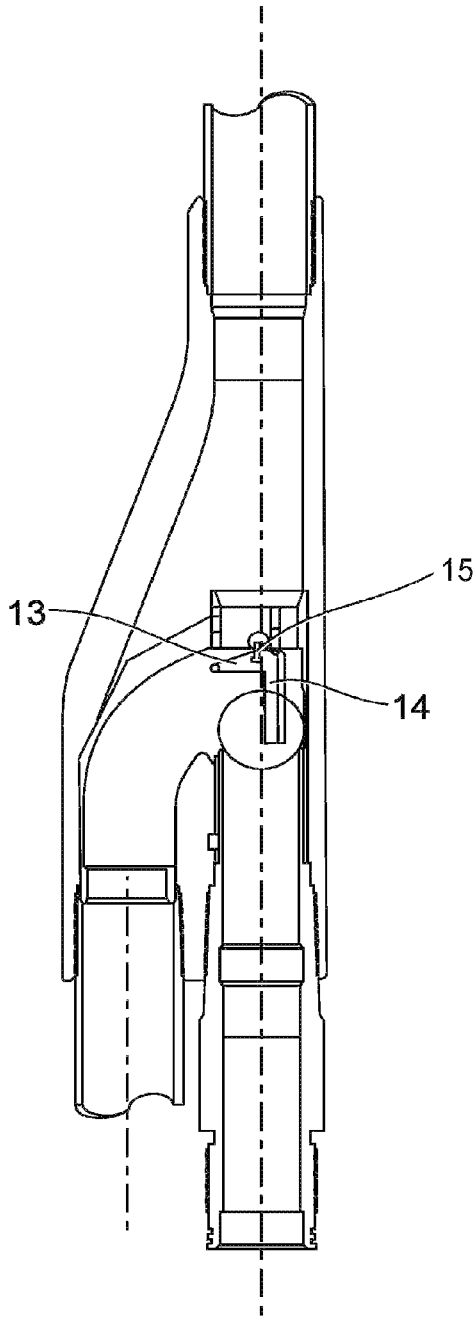
FIG. 2 is a partial cross-sectional view of the completion tool of FIG. 1 in a second operational condition.

Turning now to the drawings there is shown in FIG. 1 a completion tool 1 according to one aspect of the present invention. In the embodiment shown, the completion tool is a Y-tool 2 which comprises a substantially tubular body 3 having a main limb 4 upon which it is adapted to mount an electric submerged pump (not shown), and a by pass limb 5 which allows for the insertion of well tools or logging tools to a depth in the well below the electric submerged pump.

The main limb and bypass limb are in fluid communication through a throat 6 of the Y-tool.

In the embodiment shown, a pathway 7 is defined in the throat 6 between the top of the main limb of the Y-tool and the top of the by-pass limb. In the embodiment shown the pathway is substantially arcuate. The arcuate pathway is substantially diametric in cross-section, one half of the pathway being shown in FIG. 1.

In the embodiment shown, the top of the by-pass limb 5 of the Y-tool terminates at higher position within the throat 6 of the Y-tool than the top of the main limb 4.

A valve seat 8 is provided adjacent the top of each of the main limb and the by-pass limbs of the Y-tool. The valve seat may be provided within, upon or around the upper end of the main limb and the bypass limb.

A ball valve 9 is mounted within the throat 6 of the Y-tool, the ball valve being movable within and along the pathway 7 to take up a position either atop the main limb of the Y-tool or atop the by-pass limb. The ball valve is sized to sit within or upon the valve seats provided within or upon either of the limbs of the Y-tool. The spherical surface of the ball valve provides a surface which seals within or upon either of the valve seats of the main or by-pass limbs.

A housing 10 is mounted upon the upper portion of the by-pass limb. The housing is substantially tubular in form and has a diameter which is generally similar to or substantially matches the diameter of the by-pass limb 5.

The upper and lower ends of the housing are open to allow for the passage of well tools or logging tools into the by-pass limb when the ball valve is not seated on the top of the that limb.

An opening 11 is provided in one side of the housing which is of a size sufficient to allow the ball valve 9 to pass through.

A cradle 12 is mounted in the opening of the housing. The cradle is substantially U-shaped in cross section and comprises a body 13 which is pivotally mounted upon the underside of the opening of the housing. The body is provided with a depending legs 14 (only one of which is shown in the figures) which are mounted substantially at right angles to the body. The legs may be separate members or may be integrally formed with the body of the cradle.

The leg 14 may have an arcuate form which may substantially match the curvature of the housing. Preferably, the cradle will have a substantially horse-shoe shape.

The cradle 12 is mounted to the housing 10 through a pivot pin 15 and can pivot such that the legs move towards and away from the inner wall of the housing.

Biasing means (not shown) are provided on the housing to bias the legs 14 of the cradle towards the opening 11 of the housing, away from the inner wall of the housing. The biasing means may be provided by a spring such as for example a tension spring mounted between the upper surface of the body of the cradle and the housing.

The cradle 12 can be rotated about the pivot pin 15 against the bias when the ball valve 9 moves from a position atop the main limb 4 of the Y-tool to a position atop the by-pass limb 5.

The operation of the tool will now be described.

FIG. 1 shows the completion tool in a first operating condition when the electric submerged pump is switched off. In this condition, no fluid is pumped up the main limb 4 of the Y-tool and the ball valve 9 rests in the valve seat 8 on top of the main limb. The by-pass limb 5 is open for the insertion of logging tools into the well beneath the electric submerged pump.

In this condition, the legs 14 of the cradle 12 are pivoted towards the opening 11 in the side of the housing 10. It will be appreciated that the cradle does not preclude the insertion of logging tools into the by-pass limb.

When the electric submerged pump is operating, fluid is pumped up the main limb 4 of the Y-tool. This establishes a pressure differential across the ball valve 9 which closes off the main limb of the Y-tool. The increase in pressure below the ball valve lifts the ball valve 9 from its position atop the main limb of the Y-tool. The ball valve moves under influence of the fluid pressure and is carried along the arcuate pathway 7 in the throat 6 of the Y-tool until it enters the opening 11 in the housing at the top of the by-pass limb of the Y-tool which is provided at the other end of the arcuate pathway.

As the ball valve enters the opening 11 in the housing, the cradle 12 is rotated backwards against the bias of the spring such that the legs 14 of the cradle move towards the inner wall of the housing and the ball valve 9 sits atop the by-pass limb of the Y-tool. The surface of the ball valve provides a sealing surface within the by-pass limb.

The ball valve 9 is held in this position atop the by-pass limb against the bias of the spring by fluid pressure from fluid passing up the main limb of the Y-tool from the electric submerged pump and out of the throat 6 of the Y-tool.

When the electric submerged pump is switched off, the fluid pressure within the main limb 4 of the Y-tool drops and the spring bias pivots the cradle 12 back towards the opening 11 of the housing. As the legs 14 of the cradle are pivoted, the ball valve 9 is pushed by the legs of the cradle off the top of the by-pass limb 5 from where it falls under gravity back down the arcuate passageway 7 until it sits on top of the main limb of the Y-tool.

As the ball valve moves between the two valve seats 8, the ball rotates such that each time the ball lands in one of the valve seats a fresh sealing surface is provided. This improves the efficiency of the valve and also reduces the maintenance required during operation of the valve.

In the event that replacement of the valve is required over time, it is a simple operation to recover the ball from the Y-tool and replace this with a new ball. As the ball is freely movable within the throat of the Y-tool between the two valve seats, this is a simplified operation as compared with replacement or repair of a flapper valve as previously described.

It will further be appreciated that the tension of the spring may be adjusted in order to adjust the timing of the release of the cradle 12 when the fluid pressure in the main limb 4 drops such as when the electric submerged pump is switched off.

In a further embodiment of the present invention, an electric submerged pump is mounted on each limb of the Y-tool. With the ball valve sitting on the valve seat of the first limb, when the pump mounted on that limb is activated, the pressure differential across the ball lifts the ball from the valve seat and carries the ball along the arcuate pathway 7 until it comes to rest upon the valve seat of the second limb where it is held during operation of the first pump by fluid pressure.

When the first pump is switched off and the second pump activated, the pressure differential across the ball valve is reversed and the ball valve is carried back along the pathway 7 to the valve seat on top of the first limb where it is held during operation of the second pump by fluid pressure.

In this embodiment, the cradle for biasing the ball valve out of engagement in one of the valve seats may be removed. Alternatively, if the cradle is provided, then the ball valve will move under the bias of the cradle only when both pumps are inactive.

What is claimed is:

1. A differential pressure operated blanking tool comprising:

a Y-tool comprising a substantially tubular body and having first and second limbs connected together via a throat in the body;

a valve seat located adjacent a top portion of each of the first and second limbs;

a pathway in the throat between the top portion of the first limb to the top of the second limb;

a ball valve movable within and along the pathway and selectively positionable to close one or other limb of the Y-tube against fluid flow;

a housing mounted within the tubular body and upon an upper portion of the second limb, the housing having an opening in one side thereof of a size sufficient to allow the ball to pass through; and an actuator mounted on the housing wherein fluid flow within the tool carries the ball valve along the pathway and through the opening in the housing to a position where the second limb is closed against bias of the actuator and, when said fluid flow is removed, the actuator operates to force the ball valve out of engagement with the second limb whereupon the ball passes through the opening in the housing along the pathway and towards the first limb, whereupon as the ball valve moves within and along the pathway between the first and second limbs, the ball rotates, thereby presenting a fresh sealing surface when the ball valve lands in one of the valve seats.

2. The blanking tool according to claim 1, wherein the first limb is adapted to mount an electrically operated pump thereon and the second limb is adapted to allow access by well tools or logging equipment below said pump.

3. The blanking tool according to claim 1, wherein each of the limbs is adapted to mount an electrically operated pump thereon.

4. The blanking tool according to claim 1, wherein the tool further comprises biasing means to operate the actuator when the fluid flow holding the ball valve atop the second limb is removed.

5. The blanking tool according to claim 4, wherein the housing is provided on top of the second limb.

6. The blanking tool according to claim 4, wherein the biasing means is a spring.

7. The blanking tool according to claim 1, wherein the actuator comprises a cradle which supports the ball valve.

8. The blanking tool according to claim 7, wherein the cradle comprises a substantially U-shaped body.

9. The blanking tool according to claim 8, wherein the cradle is substantially horse-shoe shaped.

10. The blanking tool according to claim 8, wherein the body is pivotally mounted to a housing, and wherein the actuator is mounted in the housing.

11. The blanking tool according to claim 1, wherein the pathway has a substantially circular inner surface.

12. The blanking tool according to claim 11, wherein the inner surface of the pathway is of a larger diameter that the ball valve.

* * * * *

UNITED STATES PATENT AND TRADEMARK OFFICE

CERTIFICATE OF CORRECTION

PATENT NO. : 8,104,540 B2
APPLICATION NO. : 12/366917
DATED : January 31, 2012
INVENTOR(S) : Leitch It is certified that error appears in the above-identified patent and that said Letters Patent is hereby corrected as shown below:

On the Title Page

At (73) please change "Pump Tools Limited" to --RMSpumptools Limited--.

Signed and Sealed this
Seventh Day of August, 2012

David J. Kappos

David J. Kappos
*Director of the United States Patent and Trademark Office*